US008665041B2

(12) United States Patent
Christenson

(10) Patent No.: US 8,665,041 B2
(45) Date of Patent: Mar. 4, 2014

(54) INTEGRATED MICROMINIATURE RELAY

(75) Inventor: Todd Richard Christenson, Albuquerque, NM (US)

(73) Assignees: HT MicroAnalytical, Inc., Albuquerque, NM (US); COTO Technology, Inc., Warwick, RI (US)

( * ) Notice: Subject to any disclaimer, the term of this patent is extended or adjusted under 35 U.S.C. 154(b) by 920 days.

(21) Appl. No.: 12/725,168

(22) Filed: Mar. 16, 2010

(65) Prior Publication Data

US 2010/0171577 A1 Jul. 8, 2010

Related U.S. Application Data

(63) Continuation-in-part of application No. 12/406,937, filed on Mar. 18, 2009, now Pat. No. 8,327,527, which is a continuation of application No. 61/038,340, filed on Mar. 20, 2008.

(51) Int. Cl.
*H01H 51/22* (2006.01)

(52) U.S. Cl.
USPC ..... 335/78

(58) Field of Classification Search
USPC ..... 335/78
See application file for complete search history.

(56) References Cited

U.S. PATENT DOCUMENTS

| | | | | |
|---|---|---|---|---|
| 2,497,547 | A | | 2/1950 | Hastings |
| 2,931,872 | A | | 4/1960 | Sprando |
| 3,087,125 | A | | 4/1963 | Scholefield |
| 3,167,625 | A | | 1/1965 | Russo |
| 3,268,839 | A | | 8/1966 | McFarland |
| 3,486,138 | A | | 12/1969 | Chalmers |
| 3,535,663 | A | | 10/1970 | Herzog |
| 3,579,158 | A | | 5/1971 | Kutyla |
| 3,586,809 | A | | 6/1971 | Santi |
| 3,652,962 | A | * | 3/1972 | Preux ..... 335/203 |
| 3,913,054 | A | | 10/1975 | Wolfe |
| 4,011,533 | A | | 3/1977 | Santi |
| 4,063,203 | A | | 12/1977 | Fujiwara et al. |
| 5,398,011 | A | * | 3/1995 | Kimura et al. ..... 335/79 |

(Continued)

FOREIGN PATENT DOCUMENTS

| | | | |
|---|---|---|---|
| CN | 1601682 | A | 3/2005 |
| DE | 10031569 | A1 | 2/2001 |

(Continued)

OTHER PUBLICATIONS

Socher, Guenther, "PCT Application No. PCT/US2011/027930 Wrtten Opinion of the International Preliminary Examining Authority Mar. 27, 2012", , Publisher: PCT, Published in: PCT.

(Continued)

*Primary Examiner* — Mohamad Musleh
(74) *Attorney, Agent, or Firm* — Kaplan Breyer Schwarz & Ottesen, LLP

(57) ABSTRACT

A micro-relay that overcomes some of the limitations and drawbacks of the prior art is disclosed. The micro-relay comprising: (1) a first substrate comprising one or more monolithically integrated planar coils for generating a magnetic field; and (2) a second substrate comprising a magnetically actuated switch having a moving contact that selectively moves in a plane parallel to its substrate. The first and second substrate are aligned and bonded to collectively provide a closed magnetic circuit that efficiently channels the generated magnetic field through the switch.

16 Claims, 9 Drawing Sheets

(56) References Cited

U.S. PATENT DOCUMENTS

| | | | | |
|---|---|---|---|---|
| 5,430,421 | A | 7/1995 | Bornand et al. | |
| 5,472,539 | A * | 12/1995 | Saia et al. | 156/155 |
| 6,040,748 | A | 3/2000 | Gueissaz | |
| 6,084,281 | A * | 7/2000 | Fullin et al. | 257/422 |
| 6,094,116 | A * | 7/2000 | Tai et al. | 335/78 |
| 6,310,526 | B1 | 10/2001 | Yip et al. | |
| 6,366,186 | B1 | 4/2002 | Hill et al. | |
| 6,410,360 | B1 | 6/2002 | Steenberge | |
| 6,469,603 | B1 * | 10/2002 | Ruan et al. | 335/78 |
| 6,809,412 | B1 | 10/2004 | Tourino et al. | |
| 6,859,122 | B2 * | 2/2005 | Divoux et al. | 335/78 |
| 6,894,592 | B2 | 5/2005 | Shen et al. | |
| 6,917,268 | B2 | 7/2005 | Deligianni et al. | |
| 6,924,966 | B2 | 8/2005 | Prophet | |
| 6,975,193 | B2 | 12/2005 | Knieser et al. | |
| 7,191,509 | B2 | 3/2007 | Cornelus Van Gastel | |
| 7,215,229 | B2 | 5/2007 | Shen et al. | |
| 7,902,946 | B2 | 3/2011 | Niblock | |
| 8,436,701 | B2 * | 5/2013 | Baks et al. | 335/78 |
| 2003/0030998 | A1 | 2/2003 | Mhani et al. | |
| 2003/0107460 | A1 * | 6/2003 | Huang | 335/78 |
| 2003/0122640 | A1 | 7/2003 | Deligianni et al. | |
| 2003/0137374 | A1 | 7/2003 | Ruan et al. | |
| 2003/0210115 | A1 | 11/2003 | Kubby et al. | |
| 2004/0017275 | A1 | 1/2004 | Cornelus Van Gastel | |
| 2006/0049900 | A1 | 3/2006 | Ruan et al. | |
| 2006/0197635 | A1 | 9/2006 | Christenson | |
| 2009/0189720 | A1 | 7/2009 | DeBarnot et al. | |
| 2010/0182111 | A1 * | 7/2010 | Hagihara et al. | 335/203 |
| 2010/0295638 | A1 * | 11/2010 | Hopper et al. | 335/78 |

FOREIGN PATENT DOCUMENTS

| | | | |
|---|---|---|---|
| JP | 2000-348594 | A | 12/2000 |
| JP | 2001-076599 | A | 3/2001 |
| JP | 2003-311698 | A | 11/2003 |
| JP | 2005-108471 | A | 4/2005 |
| JP | 2005-317360 | A | 11/2005 |
| JP | 2008-243450 | A | 10/2008 |
| WO | 2005015595 | A1 | 2/2005 |

OTHER PUBLICATIONS

"Related CN Patent Application No. CN 2009801181783 Office Action", Jan. 29, 2013, Publisher: CIPO, Published in: CN.

Bernard Rojas, "Related U.S. Appl. No. 13/587,398 Office Action", Jan. 18, 2013, Publisher: USPTO, Published in: US.

Mohamad A. Musleh, "Related U.S. Appl. No. 13/602,805 Office Action", Mar. 28, 2013, Publisher: USPTO, Published in: US.

"Related JP Patent Application No. 2011-500937 Office Action", Apr. 15, 2013, Publisher: JPO, Published in: JP.

Musleh, Mohamad A., "U.S. Appl. No. 12/406,937 Office Actiion May 18, 2012", , Publisher: USPTO, Published in: US.

Socher, Guenther, "PCT Application No. PCT/US2011/027930 International Search Report Jun. 9, 2011", , Publisher: PCT, Published in: PCT.

Copenheaver, Blaine R., "PCT Application No. PCT/US2009/037575 International Search Report May 20, 2009", , Publisher: PCT, Published in: PCT.

Musleh, Mohamad A., "U.S. Appl. No. 12/406,937 Office Action Aug. 19, 2011", Publisher: USPTO, Published in: US.

Musleh, Mohamad A., "U.S. Appl. No. 12/406,937 Requirement for Restriction/Election Dec. 29, 2011", , Publisher: USPTO, Published in: US.

Yuping Qian, "Chinese Patent Application No. 20099801181783 Notice of Grant", Aug. 20, 2013, Publisher: CIPO, Published in: CN.

"Related Japanese Patent Application No. JP 2011-500937 Final Office Action", Sep. 11, 2013, Publisher: JPO, Published in: JP.

"Related Korean Patent Application No. 10-2010-7023308 Office Action", Jul. 30, 2012, Publisher: KIPO, Published in: KR.

* cited by examiner

INTEGRATED MICROMINIATURE RELAY

CROSS REFERENCE TO RELATED APPLICATIONS

This case is a continuation-in-part of co-pending U.S. patent application Ser. No. 12/406,937, filed Mar. 18, 2009, which is incorporated by reference herein.

The underlying concepts, but not necessarily the language, of the following cases are incorporated by reference:

(1) U.S. Pat. No. 6,094,116, issued Jul. 25, 2000; and (2) U.S. Pat. No. 6,366,186, filed Apr. 2, 2002.

If there are any contradictions or inconsistencies in language between this application and one or more of the cases that have been incorporated by reference that might affect the interpretation of the claims in this case, the claims in this case should be interpreted to be consistent with the language in this case.

FIELD OF THE INVENTION

The present invention relates to magnetically actuated actuators in general, and, more particularly, to magnetically actuated micro-relays.

BACKGROUND OF THE INVENTION

Relays are electrical switching devices that use the flow of a first current to control the flow of a second current. A relay normally comprises two primary components: (1) an electromagnetic coil for generating a magnetic field based on the flow of the first current; and (2) a magnetically actuated electrical switch for controlling the second current, wherein the switch is actuated by the generated magnetic field.

Electromagnetic relays with electrical contacts are commonly comprised of a working gap that connects and disconnects the contacts, and an electromagnetic coil which produces a magnetic field that couples to the working gap via a magnetic path. To provide efficient coupling between coil and the working gap a readily magnetized or "soft" ferromagnetic material may be employed in the magnetic path. Further improvement in coupling is obtained when the soft ferromagnetic path is compact and consequently short with large cross sectional area. The force exerted on the relay contacts due to the magnetic field produced by the electromagnetic coil is a function of the material used in the device, the geometry of the coil, the number of turns in the coil itself, and the magnitude of the first current. Typically, the coil includes a large number of turns to keep the magnitude of the first current small.

In recent years, new microfabrication technologies, such as Micro-Electro Mechanical Systems (MEMS) technology, have been applied to the fabrication of relays. MEMS technology is based on planar processing operations that were first developed for use in the integrated circuit industry; however, MEMS technology affords the ability to form structures that are movable relative to their substrate. MEMS technology enables the fabrication of micro-relays that have several advantages over their macro counterparts, such as smaller size, lower cost due to the use of low-cost batch manufacturing, and new device functionality and applications that are enabled by their small size.

Prior-art micro-relays employ switches based on mechanically active switching elements such cantilever beams, doubly supported beams (i.e., bridges), plates, and membranes. These moving structures typically comprise a movable magnetic element comprising a first electrical contact. A magnetic field is applied to the magnetic element, which moves the first electrical contact into, or out of, contact with a second electrical contact (or pair of contacts) to enable or disable the flow of the second current.

Vertically actuated micro-relays comprise magnetic elements whose motion is enabled in a direction that is perpendicular to its underlying substrate. The creation of the movable structure in such a configuration is relatively straightforward using conventional MEMS-based planar processing techniques. Using planar processing to add an efficient magnetic circuit having a compact magnetic path and large cross section area to such a structure is a challenge, however. In addition, the operating characteristics of such relays are primarily determined by the thin-film properties of the layers from which the movable magnetic elements are formed. The mechanical properties of thin-film layers can vary significantly depending on deposition conditions, however. Such variation can result in inconsistent operating characteristics even among micro-relays of the same design.

Laterally actuated micro-relays comprise magnetic elements whose motion is enabled along a plane that is substantially parallel to its underlying substrate. The magnetic element is typically supported above the substrate by tethers designed to be resilient for in-plane (i.e., lateral) motion but stiff for out-of-plane (i.e., vertical) motion. The tethers and magnetic elements are defined by photolithography and etching to "sculpt" them into their desired shape. Such micro-relays avoid some of the problems associated with vertically actuated micro-relays. In particular, the operating characteristics (e.g., resiliency, actuation force, operating speed, etc.) of a laterally actuated micro-relay depend more upon the defined structure of its tethers than upon the thin-film properties of the layers from which they are formed. As a result, the operating characteristics are substantially decoupled from deleterious effects due to film stress, thickness variations, and the like.

Typically, it is most desirable to use an electromagnetic coil to control the magnetic field that actuates a micro-relay, whether the magnetic field is generated by a permanent magnet or by the electromagnetic coil itself. Implementing an electromagnetic coil within a batch wafer-level process can be quite challenging, however, due to the three-dimensional character of such a coil and the need to efficiently magnetically couple it to the movable magnetic element. Thus, unfortunately, it is difficult at best to produce a practical integrated coil that can reliably actuate these switching elements.

As a result, micro-relays in the prior art have typically relied upon poorly coupled coils or external, non-integrated coils to provide the magnetic field for actuation. With a poorly coupled coil, however, the consequent large electrical power required to energize the relay is a significant drawback. The use of an externally configured coil not only adds significant packaging cost and size, but typically poor assembly tolerances can lead to significant variation in the operating characteristics of micro-relays of the same design.

SUMMARY OF THE INVENTION

The present invention provides a microfabricated micro-relay that overcomes some of the limitations and drawbacks of the prior art. Embodiments of the present invention comprise: (1) a magnetically actuated electrical switch having a moving contact that selectively moves in a plane parallel to its substrate; (2) one or more integrated planar coils for generating a magnetic field that actuates the electrical switch; and (3) a closed magnetic circuit for efficiently channeling the magnetic field through the electrical switch.

The planar coil is monolithically integrated on a first substrate that comprises a first portion of the magnetic circuit. The electrical switch is monolithically integrated on a second substrate that comprises a second portion of the magnetic circuit. The first and second substrates are aligned and bonded to complete the closed magnetic circuit and integrate the coil and switch in the micro-relay. The completed magnetic circuit efficiently channels the generated magnetic field through the switch, which reduces the magnitude of the magnetic field that must be generated by the planar coil.

In some embodiments, the closed magnetic circuit comprises two magnetic cores. Each magnetic core comprises ferromagnetic elements formed in each of first and second substrates. In addition, portions of each magnetic core collectively define the electrical switch.

An embodiment of the present invention comprises a plurality of coils that are arranged such that the magnetic field generated by one coil is augmented by the remaining coils. As a result, the plurality of coils collectively generates a magnetic field having high field strength.

In some embodiments, multiple electromagnetic modules, each comprising at least one planar coil, are arranged such that the coils collectively generate a magnetic field. Each electromagnetic module further comprises magnetic vias and electrical vias for magnetically and electrically coupling the substrates.

An embodiment of the present invention comprises: a first substrate comprising a first coil for generating a magnetic field, wherein the coil is substantially planar and lies in a first plane, and wherein the first coil and the first substrate are monolithically integrated; and a second substrate comprising an electrical switch that comprises a first electrical contact and a second electrical contact, wherein the first electrical contact is moved by the magnetic field, and wherein the electrical switch and the second substrate are monolithically integrated, and further wherein the first electrical contact moves selectively in a second plane that is substantially parallel to the first plane.

DETAILED DESCRIPTION

The following terms are defined for use in this Specification, including the appended claims:

Electrically connected is defined as a state in which two or more points are connected such that they are at substantially the same voltage level at any current level. This can be via direct physical contact (e.g., a contact pad physically coupled with an electrical via, etc.) or through an electrically conductive intermediate (e.g., nodes of a circuit interconnected by a conductive wire or trace, etc.).

Electrically coupled is defined as a state in which two points are in electrical communication. This can be via direct physical contact (e.g., a plug in an electrical outlet, etc.), via an electrically conductive intermediate (e.g., electrical devices connected by a conductive wire or trace, etc.), or via intermediate devices, etc. (e.g., electrical devices connected through a resistor, inductor, etc.).

Figure 1:
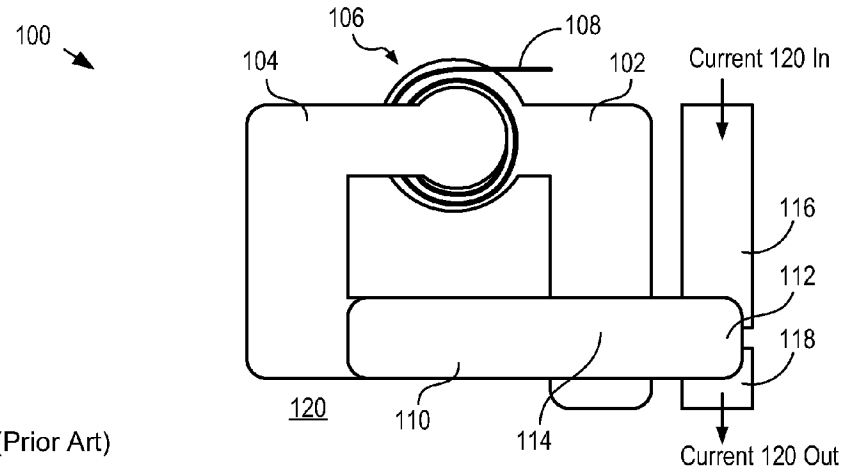
FIG. 1 (Prior Art)
FIG. 1 depicts a schematic drawing of a first micro-relay in accordance with the prior art.

FIG. 1 depicts a schematic drawing of a first micro-relay in accordance with the prior art. Relay 100 comprises magnetic elements 102 and 104, coil 108, cantilever beam 110, electrical contacts 116 and 118, and substrate 120. Examples of relays such as relay 100 are disclosed by Tai, et al. in U.S. Pat. No. 6,094,116, issued Jul. 25, 2000, which is incorporated herein by reference.

Magnetic element 102 is a layer of ferromagnetic material that is formed on the surface of substrate 120. Ferromagnetic material is material that has moderate or high magnetic permeability and is capable of channeling a magnetic field. Examples of ferromagnetic materials include permanent magnet material, nickel, nickel-iron alloy, iron, permalloy, supermalloy, Sendus™, and the like.

Magnetic element 104 is also a layer of ferromagnetic material that is formed on substrate 120 such that magnetic elements 104 overlaps magnetic element 102 in region 106. Magnetic element 104 is fabricated using conventional planar processing operations such as those included in a MEMS fabrication process. Magnetic element 104 is formed having cantilever beam 110 whose free end 112 is suspended over magnetic element 102 at region 114 to form an air gap. Free end 112 is also suspended over electrical contacts 116 and 118.

Coil 108 is a planar coil of electrically conductive material, which is electrically connected to magnetic element 102. When a first current flows through coil 108, it generates a magnetic field. Coil 108 is wrapped around region 106 such that the magnetic couples into magnetic elements 102 and 104. Further, magnetic elements 102 and 104 and coil 108 collectively define a magnetic circuit that channels the magnetic field through the air gap located at region 114.

In response to the magnetic field, a magnetic force is developed on cantilever beam 110 that pulls free end 112 vertically downward (i.e., in a direction that is orthogonal with the plane of coil 108 and substrate 120) and toward magnetic element 102. As a result, free end 112 makes contact with substrate 120 and electrically shorts electrical contacts 116 and 118 thereby enabling the flow of current 120.

Relay 100 suffers from several disadvantages. First, it relies upon the fact that the planar coil and switching element are arranged in close proximity and that the switching element moves in a direction perpendicular to the plane of the coil. As disclosed by Tai: "the two layers of magnetic material 1, 4 overlap each other at one point 5 about which the coil 3 is wrapped. This creates a planar solenoid that is very efficient at generating magnetic force." See e.g., Col. 5, lines 26-29 and FIG. 1. In addition, due to the small thickness of the magnetic circuit elements 102 and 104, the magnetic reluctance of the return magnetic circuit is high. As a result, the efficiency of the coupling between the magnetic field produced by coil 108 and the magnetic flux induced in the air gap 114 is low. A greater magneto-motive force from the coil is required, therefore, to produce a magnetic flux density in the air gap near the saturation flux density of the return magnetic circuit material. This magneto-motive force can be increased by either increasing the electric current through coil 108 or by increasing the number of turns included in coil 108. When higher current is used, the relay consumes much more power. When more coil turns are used, the planar layout of the magnetic circuit requires that the magnetic return path becomes substantially greater. This further increases magnetic reluctance and, therefore, further reduces coupling efficiency.

Since cantilever 112 moves in a direction perpendicular to the planes of coil 108 and substrate 120, the thickness and material properties of the layer from which the cantilever is formed primarily determine the mechanical behavior of the cantilever. For example, the required driving force, restoring force, resonant frequency, etc. are based on the thickness, density, residual stress, and residual stress gradient through the thickness of cantilever 112. Variations in these material properties from deposition to deposition are typical. As a result, the fact that cantilever 112 moves in a direction perpendicular to substrate 120 leads to:

i. variations in the operating characteristics of relay 100; or
ii. inconsistent operating characteristics between different relays of the same design; or
iii. repeatability and reliability issues; or
iv. variation in the contact resistance between free end 112 and each of electrical contacts 116 and 118 from relay to relay; or
v. any combination of i, ii, iii, and iv.

Furthermore, the thickness of cantilever 112 is often limited to a maximum deposition thickness inherent to the deposition process used to form the cantilever layer. The design space for relays such as relay 100 is, therefore, limited.

Figure 2:
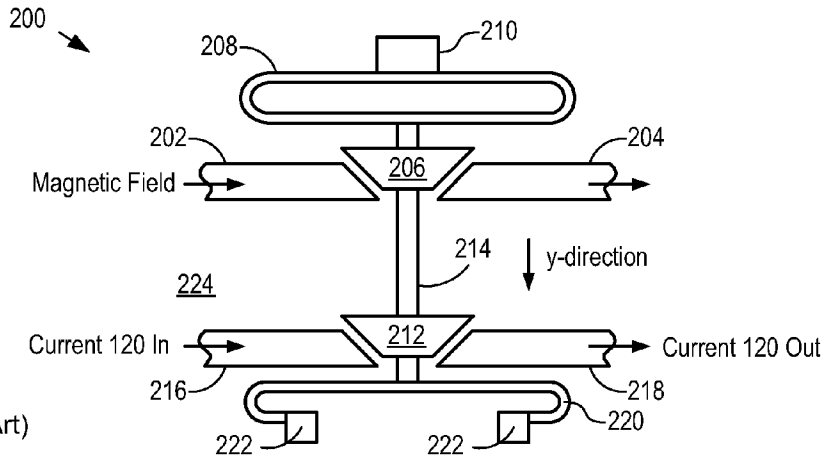
FIG. 2 (Prior Art)
FIG. 2 depicts a schematic drawing of a second micro-relay in accordance with the prior art.

FIG. 2 depicts a schematic drawing of a second micro-relay in accordance with the prior art. Relay 200 comprises magnetic elements 202, 204, and 206, springs 208 and 220, anchors 210 and 222, electrical contact 212, tether 214, electrical lines 216 and 218, and substrate 224. Examples of relays such as relay 200 are disclosed by Hill, et al. in U.S. Pat. No. 6,366,186, issued Apr. 2, 2002, which is incorporated herein by reference.

Magnetic elements 202 and 204 are layers of ferromagnetic material formed on the surface of substrate 224. Magnetic elements 202 and 204 collectively define a "magnetic flux path" for channeling an externally applied magnetic field.

Magnetic element 206 is an element comprising ferromagnetic material. Magnetic element 206 is suspended above substrate 224 by means of spring 208.

Spring 208 is a loop of structural material, such as silicon, polysilicon, etc. Spring 208 is formed into an oval shape using a conventional MEMS fabrication technique, such as deep reactive-ion etching (DRIE). Spring 208 is supported by anchor 210 above substrate 224. Spring 208 is substantially planar and lies in a first plane that is above and substantially parallel to a second plane that is defined by substrate 224.

By virtue of its shape, spring 208 is resilient in the first plane, but resistant to bending out of the first plane. Magnetic element 206 is attached to spring 208 such that it is also suspended above substrate 224. As a result, motion of magnetic element 206 in the first plane is enabled but motion of magnetic element 206 out of the first plane is inhibited.

Magnetic elements 202 and 204 are arranged to channel a magnetic field through magnetic element 206 and the gaps that separate the three magnetic elements. In operation, the magnetic field is externally applied by moving a magnetic element into proximity with relay 200.

Spring 220 is a curved structural element that is suspended above substrate 224 by anchors 222 and lies in the first plane. Similar to spring 208, spring 220 is resilient in the first plane but resists bending out of the first plane.

Electrical contact 212 is an electrically conductive element that is attached to spring 220 such that electrical contact 212 is suspended above substrate 224. As a result, motion of electrical contact 212 in the first plane is enabled but motion of electrical contact 212 out of the first plane is inhibited.

Tether 214 rigidly couples magnetic element 206 and electrical contact 212 such that they move together in the second plane.

As disclosed by Hill, "In operation, when a magnetic flux is applied along the magnetic flux path it serves to align the magnetic element with the line and generate a force that draws the magnetic element toward the line." See e.g., Hill: Col. 5, line 65 to Col. 6, line 1, and FIG. 1. Because tether 214 rigidly couples magnetic element 206 and electrical contact 212, the motion of magnetic element 206 moves electrical contact 212 (through tether 214) into physical contact with electrical lines 216 and 218. The physical contact electrically shorts electrical lines 216 and 218 and enables the flow of current 120.

Since the motion of electrical contact 212 is in a plane parallel to substrate 224, relay 200 overcomes some of the disadvantages discussed above, vis-à-vis relay 100. Specifically, the operating characteristics of relay 200 are determined primarily by photolithography.

Relay 200 also suffers from several disadvantages. First, as disclosed by Hill, the magnetic flux path embodied by magnetic elements 202 and 204 needs to be aligned with an externally applied magnetic field in order to enable reasonably efficient coupling between the magnetic field and magnetic elements 202 and 204. The need for good alignment arises from the small cross-section of magnetic elements 202 and 204, which limits the coupling efficiency of the elements to an applied magnetic field. As a result, it is necessary to provide a large magnetic field to ensure that enough magnetic force is generated at the actuator.

The need to provide a high magnetic field, in turn, makes it difficult to integrate a suitable planar coil with the structure of relay 200. The challenge arises from the fact that an electromagnetic coil capable of generating a large magnetic field with sufficiently high quality factor would require an excessive amount of chip area.

It is of note that in those embodiments disclosed by Hill wherein a coil is shown, the coil is depicted as external to the relay. Further, it is arranged to provide a magnetic field that is oriented perpendicular to the substrate through magnetic poles are formed on the top and bottom surfaces of a multi-substrate stack. These pole pieces direct the externally generated magnetic field perpendicular to the substrate stack and induce motion of a magnetically actuated electrical-contact element in a direction that is also perpendicular to each of the substrates (see e.g., Hill: Col. 8, line 59 to Col. 9, line 5, and FIG. 6). Such embodiments, of course, exhibit the same disadvantages described above, vis-à-vis relay 100.

In contrast to micro-relays of the prior art, the present invention provides a relay comprising: (1) at least one integrated coil for generating a magnetic field; (2) a magnetic circuit, magnetically coupled to the coil(s), wherein the magnetic circuit efficiently channels the generated magnetic field through a magnetically actuated electrical switch; and (3) an electrical switch having a moving element that moves in a direction parallel to the substrate. As a result, embodiments of the present invention avoid the disadvantages inherent to a switch whose moving element moves perpendicularly to its substrate, yet also include a practical integrated planar coil suitable for actuating the switch.

Advances in microfabrication technology have led to the development of planar processing techniques that enable the fabrication of structures with significant thickness relative to their lateral dimensions. This realm of process technology has been coined "high aspect-ratio" processing to indicate the substantial dimensions that may be accommodated normal to the process substrate surface. High aspect-ratio processing has enabled, for example, the development of laterally actuated micro-relays. Further, due to the advent of high aspect-ratio processing, a movable magnetic element may be now rendered with sufficient cross sectional area relative to the length of the magnetic circuit to enable relatively low-loss coupling between a source of magnetic field and the working gap.

Vertically integrated, high aspect-ratio devices are especially attractive for use in applications involving relay arrays, where extreme miniaturization becomes even more important. Use of relays in automated test equipment and telecommunication applications, for example, are particularly concerned with the footprint and height consumed by the relay on a circuit board. Since batch or wafer based fabrication costs relate directly to the device area a vertically integrated relay with smaller footprint also has a cost advantage.

Figure 3:
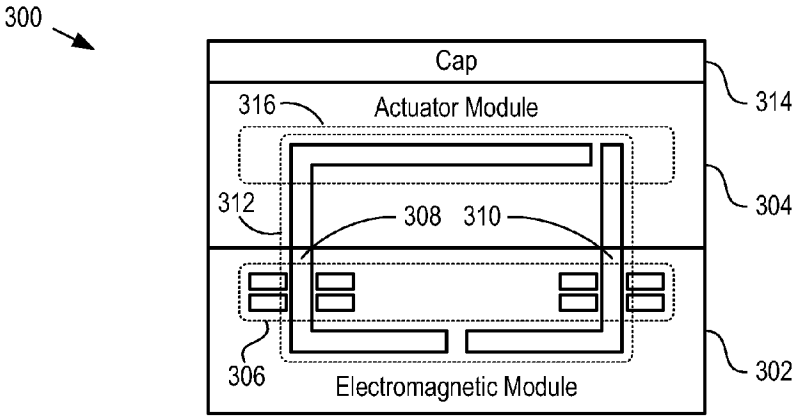
FIG. 3 depicts a simplified cross-sectional schematic drawing of a micro-relay in accordance with an illustrative embodiment of the present invention.

FIG. 3 depicts a simplified cross-sectional schematic drawing of a micro-relay in accordance with an illustrative embodiment of the present invention. Relay 300 comprises electromagnetic module 302, actuator module 304, coil 306, magnetic cores 308 and 310, cap 314, and switch 316.

Magnetic circuit 312 comprises two magnetic cores—magnetic core 308 and magnetic core 310. Each magnetic core comprises ferromagnetic elements that are formed in each of electromagnetic module 302 and actuator module 304. These ferromagnetic elements are mated in relay 300 such that they are magnetically coupled to form the magnetic cores and magnetic circuit 312. Further, portions of each of magnetic core 308 and magnetic core 310 collectively define switch 316. As described below, and with respect to FIGS. 7A and 7B, switch 316 comprises a moving contact that is enabled for motion only in a plane parallel to its underlying substrate. The magnetic circuit enables actuation of the switch using a weaker generated magnetic field. As a result, the integrated planar coil requires fewer turns so that the coil can be formed in a practical amount of chip area.

In addition, the illustrative embodiment comprises a plurality of planar coils, which work in concert to collectively generate the magnetic field. The planar coils are arranged such that a magnetic field generated by one coil is augmented by the rest of the coils. As a result, the plurality of coils collectively generates a significantly stronger magnetic field than possible for a practical single coil. By using a plurality of coils, the design parameters for each coil (e.g., number of turns, current carrying capability, etc.) are relaxed, which makes them more easily integrated in relay 300.

It is an aspect of the present invention that the coils are formed on different substrate than the magnetically actuated switch. Once formed, the different substrates are bonded to form a fully integrated device. In the illustrative embodiment, four coils 306 are formed on electromagnetic module 302. The coils are arranged in two coil pairs, wherein each coil pair surrounds one of the magnetic cores. As a result, the magnetic field generated by each coil is efficiently coupled into its respective core.

In similar fashion, switch 316 is formed on separate actuator module 304. In order to facilitate their integration in relay 300, the magnetic and electrical vias of each substrate are arranged in a common interface that ensures their proper mating when the substrates are attached.

This common interface for the magnetic and electrical vias of the electromagnetic module provides embodiments of the present invention with significant advantages with respect to design, manufacturing, and inventory control. For example, a "generic" electromagnetic module can be volume-produced with lower cost. Further, a generic electromagnetic module can be used to actuate any of a family of actuator modules through the common interface.

The common interface also enables the formation of multiple, stackable electromagnetic modules that can be assembled together to cooperatively provide any practical magnitude of magnetic field strength. As a result, embodiments of the present invention offer greater design flexibility and reduce the cost of manufacture.

Figure 4:
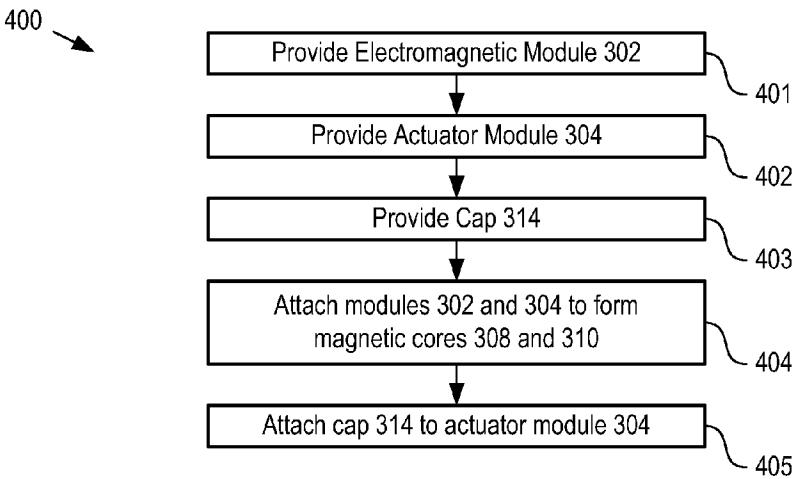
FIG. 4 depicts operations of a method for forming a micro-relay in accordance with the illustrative embodiment of the present invention.

FIG. 4 depicts operations of a method for forming a micro-relay in accordance with the illustrative embodiment of the present invention. Method 400 begins with operation 401, wherein electromagnetic module 302 is provided.

Figure 5A:
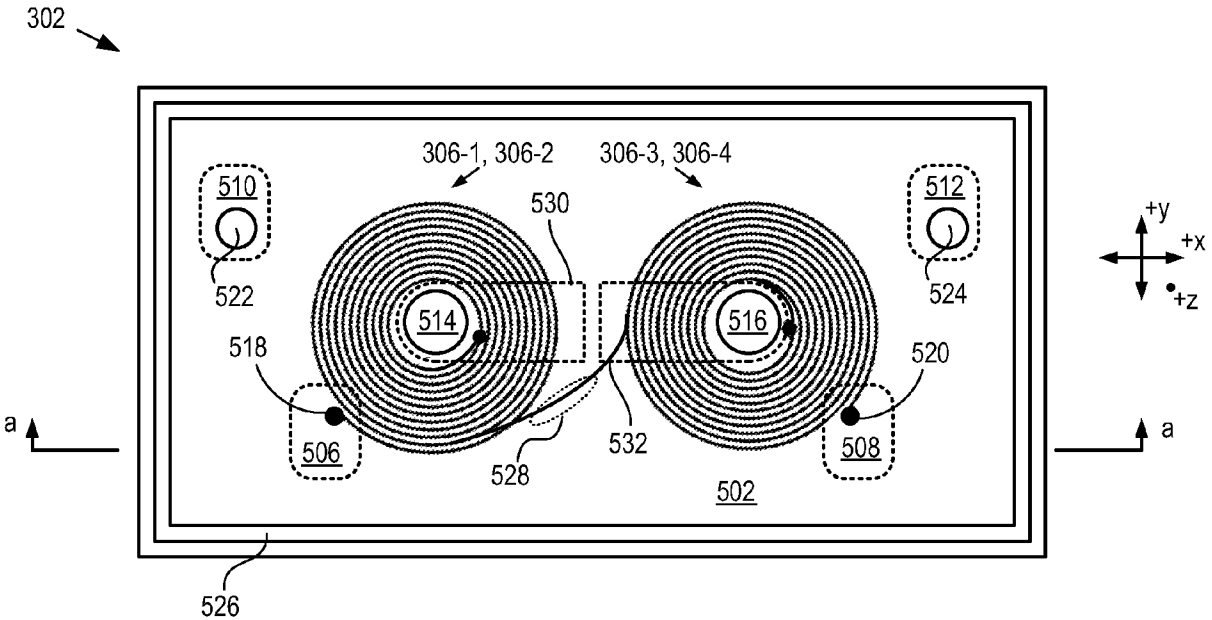
FIGS. 5A and 5B depict schematic drawings of a top view and cross-sectional view through line a-a, respectively, of electromagnetic module 302.
Figure 5B:
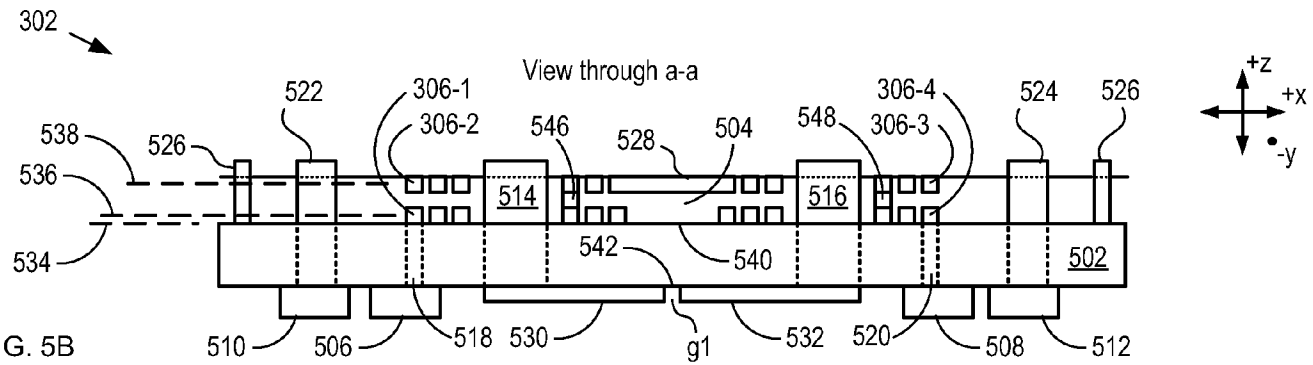

FIGS. 5A and 5B depict schematic drawings of a top view and cross-sectional view through line a-a, respectively, of electromagnetic module 302. Electromagnetic module 302 comprises elements for generating and augmenting a magnetic field, as well as elements for efficiently channeling the generated magnetic field to an actuator module. Electromagnetic module 302 further comprises a plurality of contact pads for enabling electrical connectivity and surface mounting of the substrate.

Electromagnetic module 302 comprises substrate 502, coils 306-1 through 306-4, contact pads 506, 508, 510, and 512, magnetic vias 514 and 516, electrical vias 518, 520, 522, and 524, shield 526, and magnetic pads 530 and 532. It should be noted that, for clarity, FIG. 5B depicts a cross-sectional view through the center of representational coils, rather than a view of coils 306-1 through 306-4 through line a-a.

Figure 6:
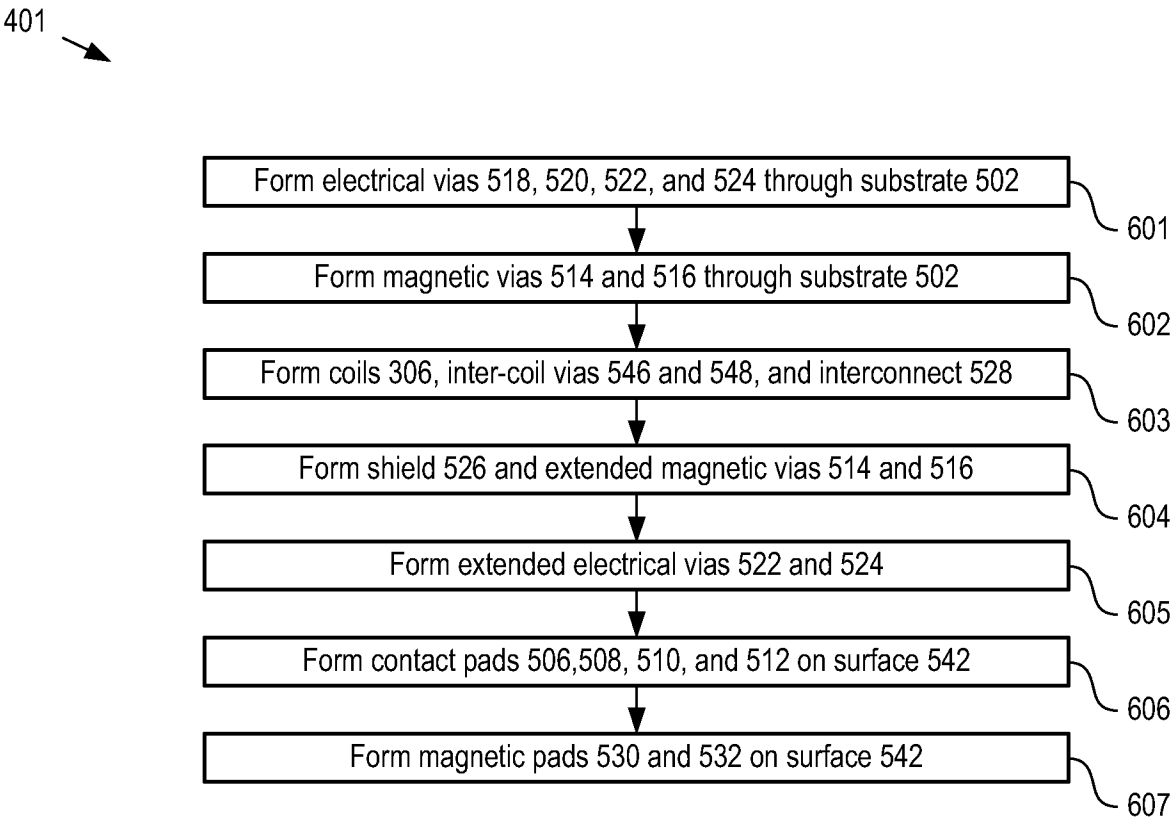
FIG. 6 depicts sub-operations suitable for use in operation 401, wherein electromagnetic module 302 is formed in accordance with the illustrative embodiment of the present invention.

FIG. 6 depicts sub-operations suitable for use in operation 401, wherein electromagnetic module 302 is formed in accordance with the illustrative embodiment of the present invention. Operation 401 begins with sub-operation 601, wherein through-wafer electrical vias 518, 520, 522, and 524 are formed in substrate 502.

Substrate 502 is a substrate suitable for supporting the microfabrication of one or more electrically conductive coils. In the illustrative embodiment, substrate 502 is an alumina substrate; however, it will be clear to one skilled in the art, after reading this Specification, how to specify, make, and use alternative embodiments of the present invention wherein substrate 502 is any suitable substrate. For the purposes of this Specification, including appended claims, "substrate" is defined as a substrate that is suitable for planar processing fabrication operations such as those typically employed in MEMS fabrication, nanotechnology fabrication, or integrated circuit fabrication. Examples of suitable substrate materials include, without limitation, silicon, germanium, compound semiconductors, semiconductor-on-insulator layer structures, glass, ceramics, alumina, etc., and combinations thereof.

Electrical vias 518, 520, 522, and 524 are formed in conventional fashion, wherein holes are formed through substrate 502 are then filled with electrically conductive material, such as, for example, gold, aluminum, doped polysilicon, and tungsten. The holes can be formed using any suitable fabrication technique, such as DRIE, sand blasting, water drilling, laser-assisted etching, and the like. In some embodiments, such as those wherein substrate 502 is a cast ceramic substrate, the holes can be formed during formation of the substrate.

The holes are filled with electrically conductive material using a conventional technique, such as electroplating, chemical vapor deposition, and the like. In some embodiments substrate 502 comprises an electrically conductive material or a semi-conductor. In such embodiments, an insulating layer is first deposited on the sidewalls of the holes to electrically isolate each electrical via from substrate 502. It will be clear to one skilled in the art how to specify, make, and use electrical vias 518, 520, 522, and 524.

At sub-operation 602, through-wafer magnetic vias 514 and 516 are formed in substrate 502. Formation of magnetic vias 514 and 516 is analogous to the formation of the electrical vias described above; however, magnetic vias 514 are formed with ferromagnetic material and are therefore capable of channeling magnetic flux between surfaces 540 and 542 of substrate 502 as part of magnetic circuit 312, as described below and with respect to FIG. 9.

At sub-operation 603, coils 306-1 through 306-4, inter-coil vias 546 and 548, and interconnect 528 are formed. It should be noted that in embodiments wherein substrate 502 is an electrically conductive or a semi-conducting substrate, surface 540 comprises an electrically insulating layer upon which the coils are disposed.

Each of coils 306-1 through 306-4 (collectively referred to as coils 306) is a substantially planar spiral of electrically conductive material that generates a magnetic field when energized by a current. Each of coils 306 lies in a plane that is substantially parallel to plane 534, which is defined by substrate 502. Specifically, coils 306-1 and 306-4 are coplanar and lie in plane 536 and coils 306-2 and 306-3 are coplanar and lie in plane 538. In some embodiments, each of coils 306 lies in a different plane, wherein each of these planes is substantially parallel to one another. Although the illustrative embodiment comprises four coils 306, it will be clear to one skilled in the art, after reading this Specification, how to specify, make, and use alternative embodiments of the present invention that comprise any practical number of coils that is less than or greater than four.

When energized with current, each of coils 306 generates a magnetic field that is oriented in a direction based on the direction of its flow through that coil. In the illustrative embodiment, coils 306-1 and 306-2 are dimensioned and arranged such that they are substantially concentric and the magnetic flux generated by each is directed in the positive z-direction at planes 536 and 538, respectively. As a result, the magnetic field generated by coil 306-1 can be augmented by the magnetic field generated by coil 306-2 (or visa-versa). Coils 306-3 and 306-4 are dimensioned and arranged such that they are substantially concentric and the magnetic flux generated by each is directed in the negative z-direction at planes 538 and 536, respectively. As a result, the magnetic field generated by coil 306-3 is augmented by the magnetic field generated by coil 306-4 (or visa-versa). Further, the magnetic fields generated by coils 306-3 and 306-4 augment the combined magnetic field generated by coils 306-1 and 306-2 through magnetic circuit 312, as described below and with respect to FIG. 9. It should be noted that the direction of current flow through the coils and the relative orientation of the coils are matters of design choice. Further, the physical layout of coils 306, such as number of turns, cross-section of the coil trace, type of electrically conductive material, are also matters of design choice and it will be clear to one skilled in the art, after reading this Specification, how to specify, make, and use coils 306.

Coils 306-1 through 306-4, inter-coil vias 546 and 548, and interconnect 528 are formed using a series of dielectric layer depositions, dielectric etching, metal depositions, and electroplating. Coils 306-1 and 306-4 are formed on surface 540 of substrate 502 by operations including: (1) depositing a first layer of electrically conductive material on surface 540; (2) forming a mask layer on the first layer, wherein the mask layer includes openings in the desired shapes of coils 306-1 and 306-4; (3) immersing the substrate in an electroplating bath, wherein electrically conductive material is selectively deposited in the open areas of the mask layer; and (4) removing the mask layer and non-plated regions of the first layer. After their formation, coils 306-1 and 306-4 are electrically connected to electrical vias 518 and 520, respectively, but are not electrically connected to one another. It should be noted that electroplating represents only one suitable technique for forming coils 306 and that one skilled in the art, after reading this Specification, will be able to specify and use any suitable alternative technique to form coils 306 in accordance with the present invention.

After the formation of coils 306-1 and 306-4, they are encapsulated by the deposition of dielectric layer 504. Dielectric layer 504 is planarized using, for example, chemical-mechanical polishing. Inter-coil vias 546 and 548 are formed through dielectric layer 504 such that they are electrically connected to coils 306-1 and 306-2, respectively.

Coil 306-2, coil 306-3, and interconnect 528 are then formed on dielectric layer 504 such that coils 306-2 and 306-3 are electrically connected to inter-coil vias 546 and 548 and coils 306-2 and 306-3 are electrically connected through interconnect 528. Upon completion, electrical via 518, coils 306, inter-coil vias 546 and 548, interconnect 528, and electrical via 520 collectively define a continuous electrically conductive path.

At sub-operation 604, magnetic vias 514 and 516 are extended vertically and shield 526 is formed using conventional photolithography and electroplating operations. When relay 300 is fully assembled, shield 526 forms a portion of a barrier for protecting relay 300 from the effects of stray magnetic fields.

Coils 306-1 and 306-2 are substantially concentric and surround magnetic via 514 in planes 536 and 538, respectively. Coils 306-3 and 306-4 are concentric and surround magnetic via 516 in planes 536 and 538, respectively. The vertical extension of magnetic vias 514 and 516 enables their physically contact with magnetic vias included in actuator module 304 as part of magnetic circuit 312, as described below and with respect to FIGS. 7-10.

At sub-operation 605, electrical vias 522 and 524 are extended vertically by patterning dielectric 504 and electroplating electrically conductive material. The vertical extension of electrical vias 522 and 524 enable subsequent electrical contact between them and electrical vias 708 and 710 of actuator module 304.

At sub-operation 606, electroplating is used to form electrically conductive contact pads 506, 508, 510, and 512 on surface 542. The contact pads are formed such that contact pad 506 is electrically connected to electrical via 518, contact pad 508 is electrically connected to electrical via 520, contact pad 510 is electrically connected to electrical via 522, and contact pad 512 is electrically connected to electrical via 524. As a result, electromagnetic module 302 is suitable for surface mount attachment.

At sub-operation 607, magnetic pads 530 and 532 are formed, via electroplating, on surface 542. Each of magnetic pads 530 and 532 comprises ferromagnetic material and can channel a magnetic field. Upon completion of sub-operation 607, magnetic via 514 is physically connected to magnetic pad 530 and magnetic via 516 is physically connected to magnetic pad 532. It should be noted that magnetic pads 530 and 532 are physically separated by armature gap g1. Armature gap g1 electrically isolates magnetic pads 530 and 532 from one another and avoids development of an undesirable shunt for electric current during operation of relay 300. Armature gap g1 is typically made as small as possible, however, to ensure a low-reluctance path between magnetic pads 530 and 532.

Although in the illustrative embodiment, electroplating is used to form elements included in electromagnetic module 302, it will be clear to one skilled in the art, after reading this Specification, how to specify, make, and use coils and/or other elements that are formed using other planar fabrication techniques, such as photolithography, electroplating, metal lift-off, subtractive layer patterning (e.g., etching, ablation, sand blasting, etc.), and the like.

At operation 402, actuator module 304 is provided.

Figure 7A:
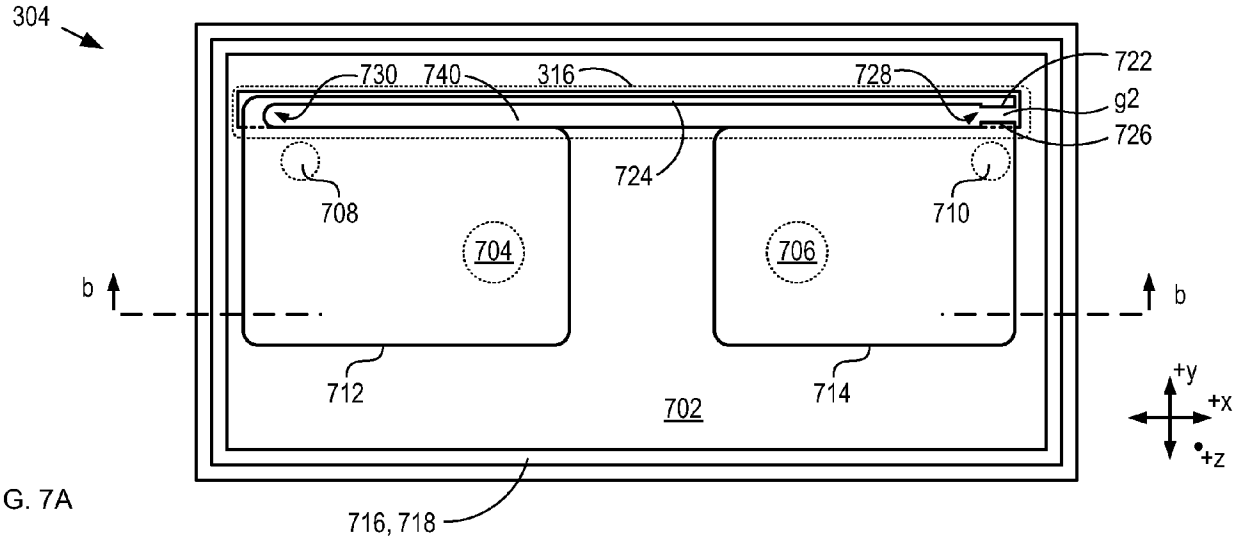
FIGS. 7A and 7B depict schematic drawings of a top view and cross-sectional view through line b-b, respectively, of actuator module 304.
Figure 7B:
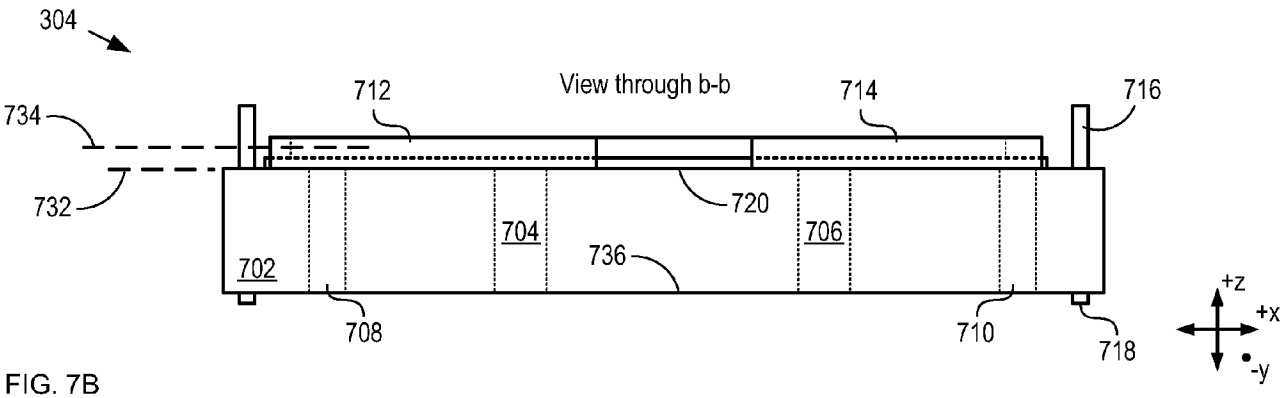

FIGS. 7A and 7B depict schematic drawings of a top view and cross-sectional view through line b-b, respectively, of actuator module 304. Actuator module 304 comprises substrate 702, switch 316, anchors 712 and 714, magnetic vias 704 and 706, electrical vias 708 and 710, seal ring 718, and shield 716.

Figure 8:
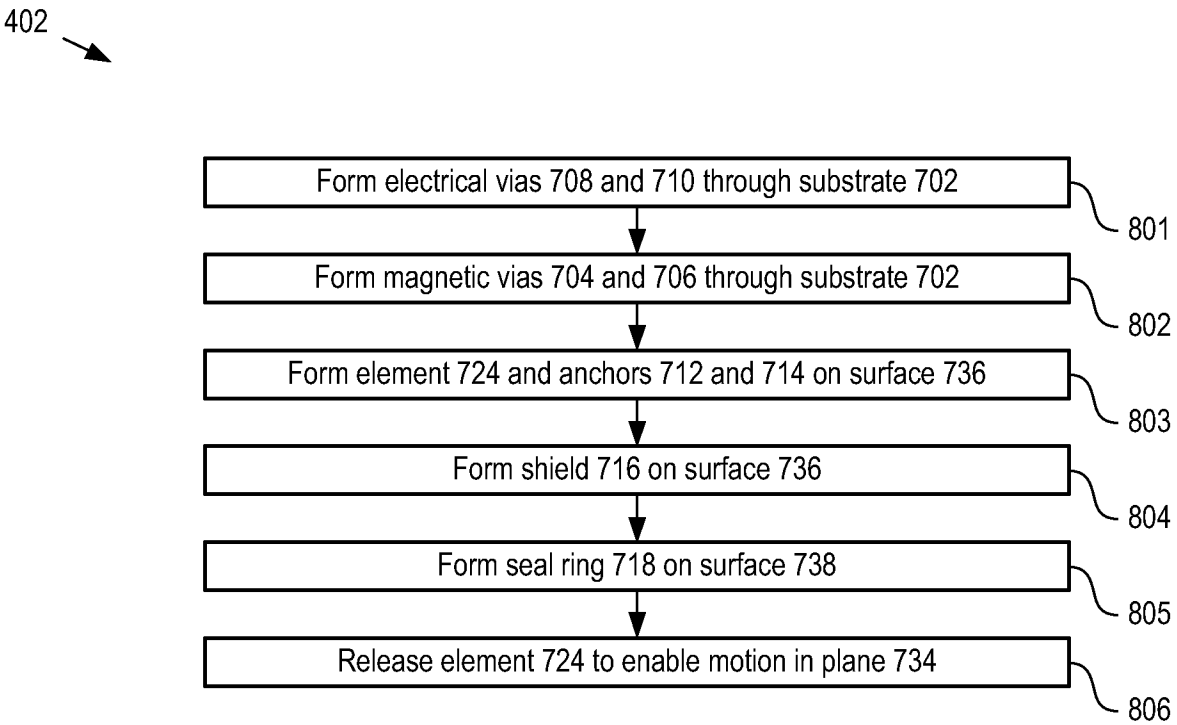
FIG. 8 depicts sub-operations suitable for use in operation 402, wherein actuator module 304 is formed in accordance with the illustrative embodiment of the present invention.

FIG. 8 depicts sub-operations suitable for use in operation 402, wherein actuator module 304 is formed in accordance with the illustrative embodiment of the present invention. Operation 402 begins with sub-operation 801, wherein through-wafer magnetic vias 704 and 706 are formed in substrate 502.

Substrate 702 is a substrate suitable for supporting the formation of switch 316. Substrate 702 defines plane 732. Substrate 702 is analogous to substrate 502.

Magnetic vias 704 and 706 are through-wafer magnetic vias that are analogous to magnetic vias 514 and 516. Magnetic vias 704 and 706 are physically connected and magnetically coupled to anchors 712 and 714, respectively.

At sub-operation 802, through-wafer electrical vias 708 and 710 are formed in substrate 702. Electrical vias 708 and 710 are through-wafer electrical vias that are analogous to electrical vias 514, 518, 520, and 524.

Magnetic vias 704 and 706 and electrical vias 708 and 710 are arranged in the same arrangement as magnetic vias 514 and 516 and electrical vias 522 and 524 of electromagnetic module 302. This matching arrangement provides the "common interface," referred to above, between electromagnetic module 302 and actuator module 304. Once the substrates are aligned and bonded, therefore, magnetic vias 704 and 706 and magnetic vias 514 and 516 are magnetically coupled and electrical vias 708 and 710 and electrical vias 522 and 524 are electrically connected. In some embodiments, magnetic vias 704 and 706 and magnetic vias 514 and 516 are in physical contact when substrates 302 and 304 are aligned and bonded.

At sub-operation 803, electroplating is again used to form anchors 712 and 714 disposed on surface 720 of substrate 702.

Each of anchors 712 and 714 comprises a material that is both ferromagnetic and electrically conductive. Anchor 712 and electrical via 708 are electrically connected. Anchor 712 is also physically and magnetically coupled with magnetic via 704. In similar fashion anchor 714 and electrical via 710 are electrically connected and anchor 714 and magnetic via 706 are magnetically coupled.

Element 724 is also formed during the formation of anchor 712. In order to enable operation of relay 300, however, sacrificial layer 740 is formed such that it interposes element 724 and surface 720. One skilled in the art will recognize that sacrificial layer 740 can comprise any material that can be selectively removed from electromagnetic module 304. The choice of material for use as sacrificial layer 740 depends on the material from which anchors 712 and 714 and element 724 are formed. It will be clear to one skilled in the art, after reading this Specification, how to specify, make, and use sacrificial layer 740.

Element 724 is a cantilever beam disposed from anchor 712. After release of element 724 from the substrate, end 730 of element 724 is rigidly connected at anchor 712. End 728 of element 724, however, is free to selectively move within plane 734, which is substantially parallel to plane 732. End 728 comprises electrical contact 722. In other words, element 724 is dimensioned and arranged to enable motion of contact 722 within plane 734 but inhibit motion of contact 722 out of plane 734.

In some alternative embodiments, element 724 is a mechanical element other than a cantilever beam but still enables motion of contact 722 within plane 734. Element 724 comprises a material that is both ferromagnetic and electrically conductive. As a result: (1) electrical via 708, anchor 712, element 724, and electrical contact 722 collectively define a continuous electrically conductive path; and (2) magnetic via 704, anchor 712, element 724, and electrical contact 722 collectively define a continuous ferromagnetic path.

Anchor 714 comprises electrical contact 726. Electrical contact 722, element 724, and contact 726 collectively define magnetically actuated switch 316. Initially, electrical contacts 722 and 726 are separated by working gap, g2, when switch 316 is in its non-actuated state.

In some embodiments, one or both of electrical contacts 722 and 726 comprise projections for concentrating contact force and reducing electrical contact resistance between them. In some embodiments, one or both of electrical contacts 722 and 726 comprise a low resistivity material, such as gold, for reducing electrical contact resistance between them.

At sub-operation 804, shield 716 is formed on surface 720. Shield 716 is analogous to shield 526. Shield 716 is dimensioned and arranged to mechanically bond with cap 314 when relay 300 is assembled. When relay 300 is fully assembled, shield 716 forms a portion of a barrier for protecting relay 300 from the effects of stray magnetic fields.

At sub-operation 805, seal ring 718 is formed on surface 736. Seal ring 718 is a thin metal layer that provides a suitable bonding surface for shield 526 during assembly of electromagnetic module 302 and actuator module 304.

At sub-operation 806, element 724 is released from surface 720 by selective removal of sacrificial layer 740. Since element 724 selectively moves in plane 734, its mechanical behavior is based, not on its dimension in the z-direction, but on its width in the y-direction. As a result, the mechanical behavior of element 724 is lithographically determined during the formation of the mask layer used to define the element during the electroplating process. Photolithography is an extremely well-controlled and repeatable process. Thus, operational characteristics can be tightly controlled and consistent across all relays of the same design. Furthermore, photolithography enables the definition of element 724 with extremely tight dimensional tolerances. This enables the design of a relay with an extremely small working gap, g2, and, therefore, a low actuation magnetic field requirement.

At operation 403, cap 314 is provided. Cap 314 forms a portion of a shield for protecting switch 316 and coils 306 from the effects of stray magnetic fields. Cap 314 is dimensioned and arranged to mechanically bond with shield 716 when relay 300 is fully assembled.

At operation 404, electromagnetic module 302, actuator module 304, and cap 314 are assembled to form relay 300. During assembly of relay 300, electromagnetic module 302 and actuator module 304 are aligned so that magnetic vias 514 and 516 are in physical contact with magnetic vias 704 and 706, respectively. In addition, the substrates are aligned so that electrical vias 522 and 524 make electrical contact with electrical vias 708 and 710, respectively. Once they are aligned as desired, electromagnetic module 302, actuator module 304, and cap 314 are bonded to one another using conventional bonding techniques.

Figure 9:
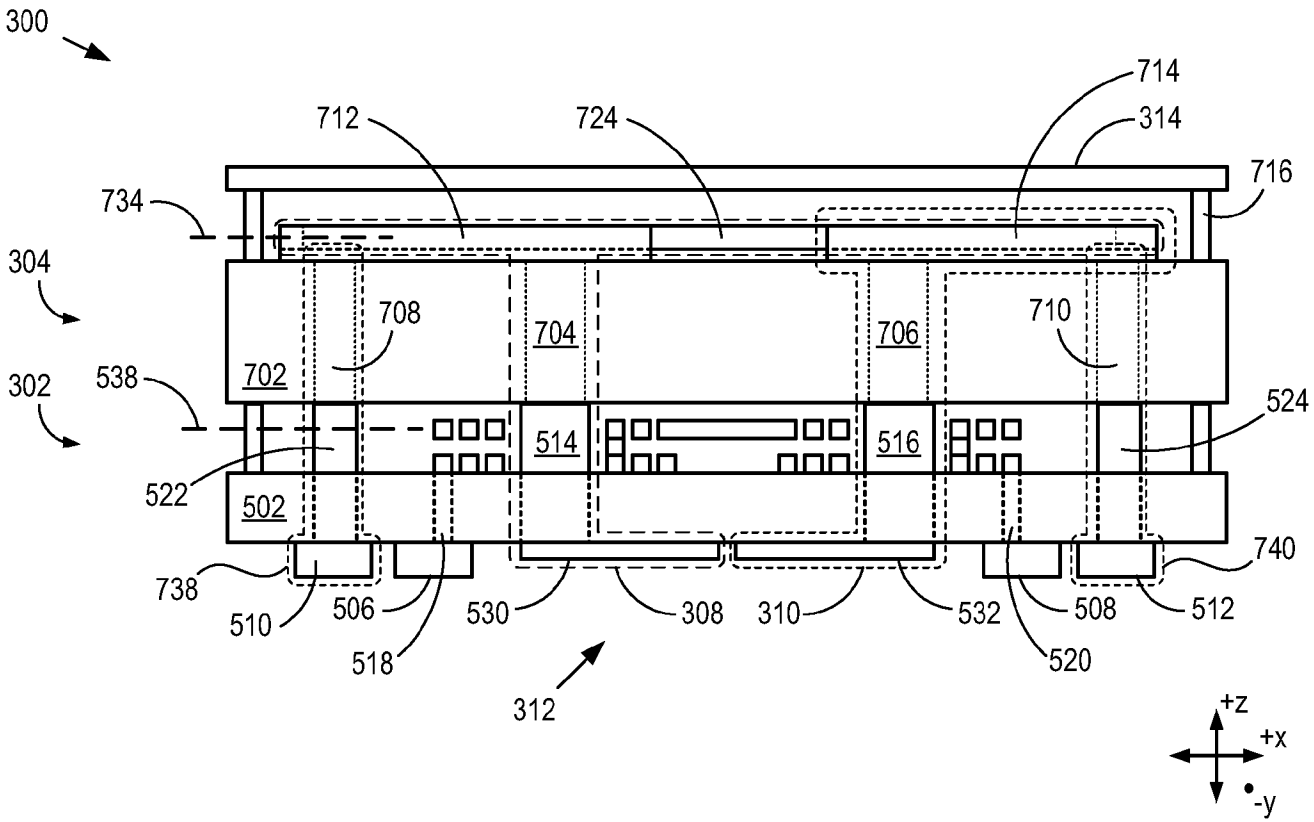
FIG. 9 depicts a cross-sectional view of fully assembled relay 300 in accordance with the illustrative embodiment of the present invention.

FIG. 9 depicts a cross-sectional view of fully assembled relay 300 in accordance with the illustrative embodiment of the present invention.

After assembly of relay 300, magnetic pad 530, magnetic vias 514 and 704, anchor 712, and element 724 collectively define magnetic core 308. Magnetic core 308 is surrounded by coils 306-1 and 306-2 in planes 536 and 538, respectively. As a result, the magnetic fields generated by each of coils 306-1 and 306-2 are efficiently coupled into magnetic core 308.

In similar fashion, magnetic pad 532, magnetic vias 516 and 706, and anchor 714 collectively define magnetic core 310. Magnetic core 310 is surrounded by coils 306-4 and 306-3 in planes 536 and 538, respectively. As a result, the magnetic fields generated by each of coils 306-3 and 306-4 are efficiently coupled into magnetic core 310.

Figure 10:
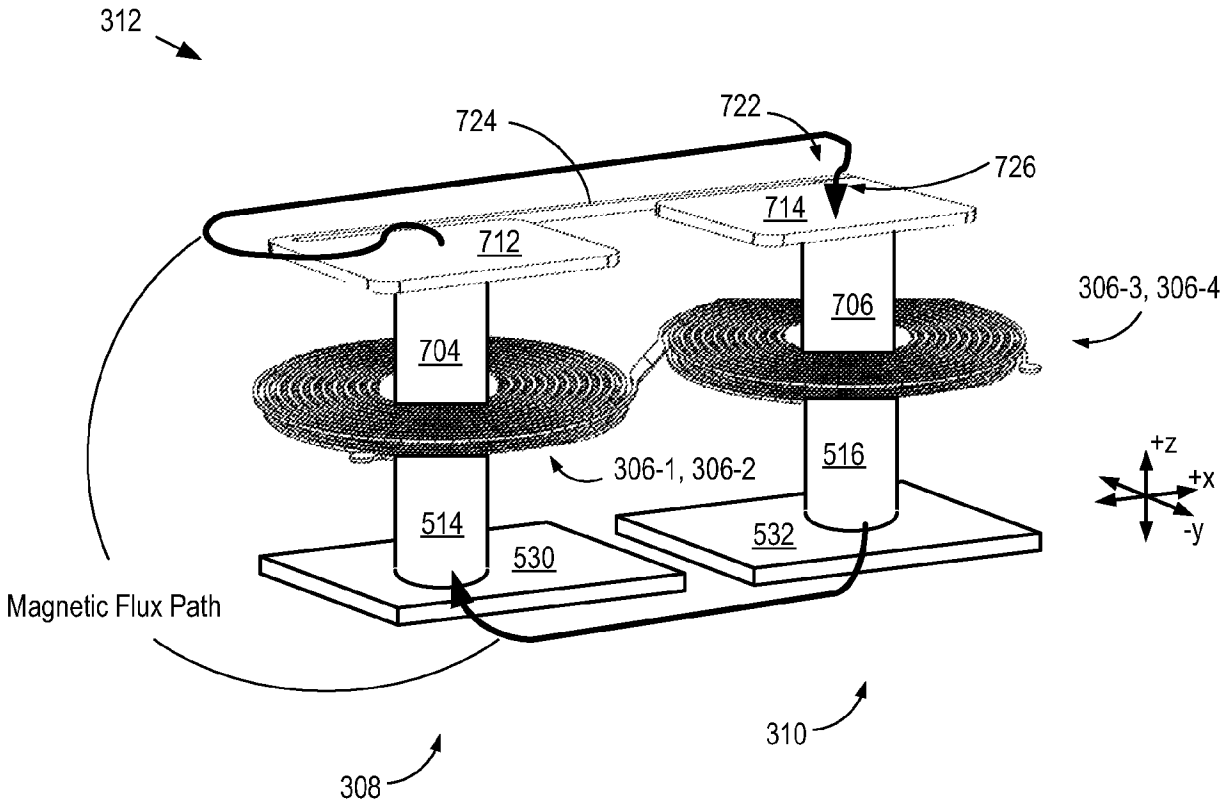
FIG. 10 depicts a magnetic circuit in accordance with the illustrative embodiment of the present invention.

Magnetic cores 308 and 310 collectively define magnetic circuit 312, which is depicted in FIG. 10. Magnetic circuit 312 is referred to herein as a "closed magnetic circuit." For the purposes of this Specification, including the appended claims, the term "closed magnetic circuit" is defined as a circuit of ferromagnetic material that enables the circulation of a magnetic field through a closed path. In other words, a closed magnetic circuit has a substantially ferromagnetic return path that channels a magnetic field back to its source. A closed magnetic circuit can comprise one or more air gaps; however, the air gaps are sufficiently small that they enable efficient magnetic coupling across them. Magnetic circuit 312 channels the magnetic field collectively generated by coils 306 through switch 316, including working gap g2. As discussed above, and with respect to FIGS. 5A and 5B, the magnetic fields generated by coils 306-1 and 306-2 are directed in the positive z-direction at planes 536 and 538, respectively and the magnetic fields generated by coils 306-3 and 306-4 are directed in the negative z-direction at planes 538 and 536, respectively. These magnetic fields are channeled by magnetic circuit 312 in a generally clockwise direction (as depicted in FIG. 10).

Once relay 300 is assembled, electrical via 708, electrical via 522, and contact pad 510 collectively define terminal 738, which is electrically connected to magnetic core 308. In similar fashion, electrical via 710, electrical via 524, and contact pad 512 collectively define terminal 740, which is electrically connected to magnetic core 310. It should be noted that in some embodiments, switch 316 is disposed on surface 736 of actuator module 304. In such embodiments, magnetic vias 704 and 706, electrical vias 708 and 710, and cap 314 are not required. Further, in some embodiments, magnetic vias 514 and 516 are in close proximity to, but not in physical contact with, magnetic vias 704 and 706.

In operation, a first current is injected at contact pad 506 and flows from contact pad 506 to contact 508 through electrical vias 518 and 520 and coils 306. This first current energizes each of coils 306. In response to the flow of the first current, coil 306-1 generates a magnetic field that is augmented by coils 306-2 through 306-4 and channeled by magnetic circuit 312 through electrical contacts 722 and 726 and working gap g2. As a result, free end 728 of element 316 is attracted toward electrical contact 726 to force electrical contacts 722 and 726 into physical and electrical contact. It should be noted that the mechanical design of element 724 and the size of working gap g2 determine the amount of force required to actuator switch 316.

By virtue of the electrical connection between electrical contacts 726 and 722, a flow of a second current between contact pads 510 and 512 (through electrical vias 522, 708, 710, and 524) is enabled.

In some embodiments, electrical contacts 722 and 726 are initially in physical and electrical contact and the flow of the first current induces a separation of electrical contacts 722 and 726 to disable the flow of the second current.

Figure 11:
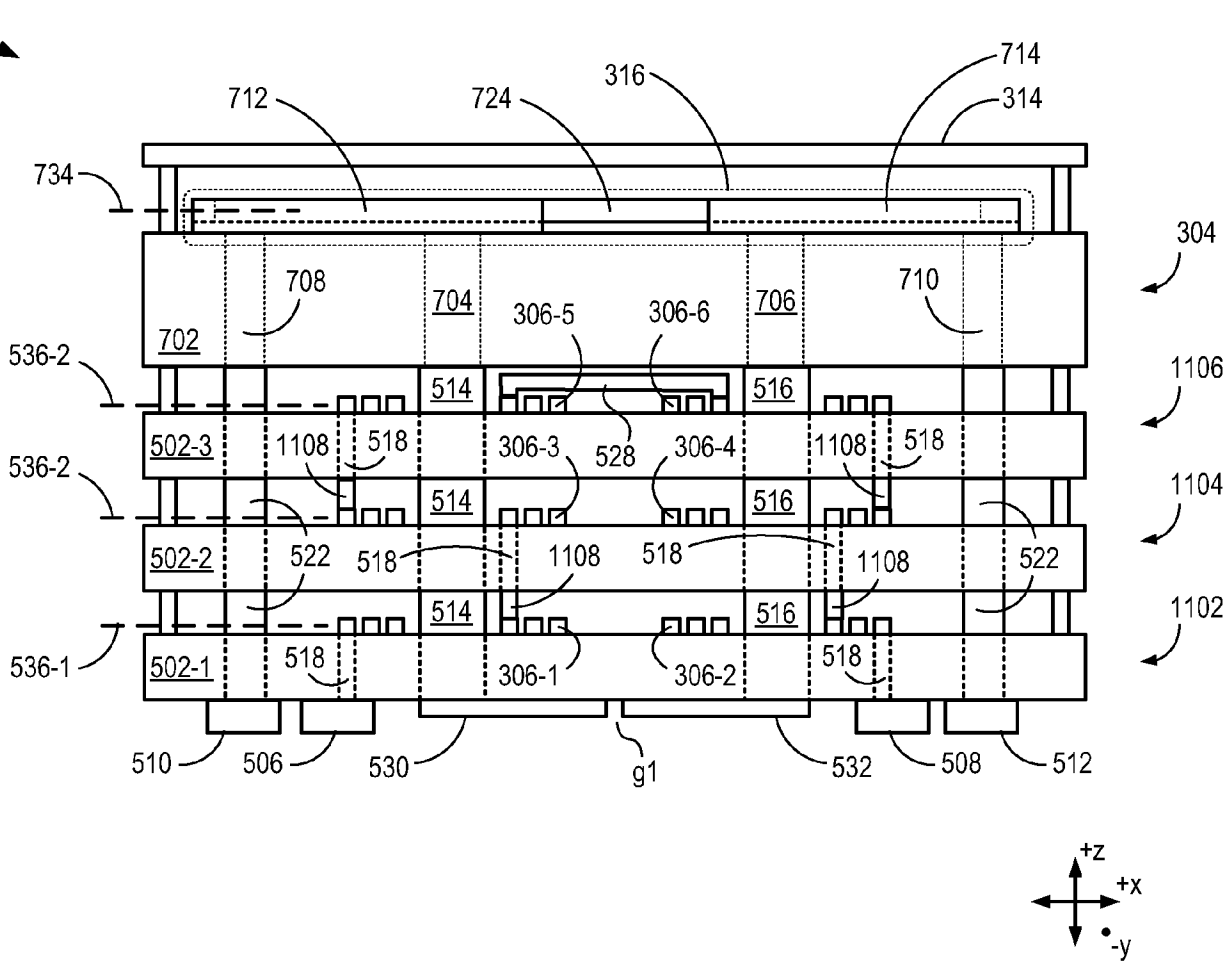
FIG. 11 depicts a schematic diagram of a simplified cross-sectional view of a micro-relay in accordance with a first alternative embodiment of the present invention.

FIG. 11 depicts a schematic diagram of a cross-sectional view of a micro-relay in accordance with a first alternative embodiment of the present invention. Relay 1100 comprises electromagnetic modules 1102, 1104, and 1106, actuator module 304, and cap 314.

Each of electromagnetic modules 1102, 1104, and 1106 is analogous to electromagnet substrate 302; however, each comprises only two coils for generating a magnetic field.

Electromagnetic module 1102 comprises substrate 502-1, contact pads 506, 508, 510, and 512, coils 306-1 and 306-2, electrical vias 522, and magnetic vias 514.

Electromagnetic module 1104 comprises substrate 502-2, coils 306-3 and 306-4, electrical vias 522, and magnetic vias 514. In some embodiments, electromagnetic module 1104 is flipped about the x-axis such that coils 306-3 and 306-4 are disposed on the bottom surface of substrate 502-2.

Electromagnetic module 1106 comprises substrate 502-3, coils 306-5 and 306-6, electrical vias 522, and magnetic vias 514. In some embodiments, electromagnetic module 1106 is flipped about the x-axis such that coils 306-5 and 306-6 are disposed on the bottom surface of substrate 502-3.

Electromagnetic modules 1102, 1104, and 1106 are aligned and bonded such that their magnetic vias are magnetically coupled to form a closed magnetic circuit that is analogous to magnetic circuit 312. In addition, coils 306 are electrically connected in series via electrical vias 518 and 1108, and interconnect 528 so that coils 306-3 and 306-4 form a continuous path for current.

Although the first alternative embodiment comprises three electromagnetic modules, it will be clear to one skilled in the art, after reading this Specification, how to specify, make, and use alternative embodiments of the present invention that comprise any practical number of electromagnetic modules.

The ability to stack any number of electromagnetic modules together enables wide design latitude for actuator design, lower inventory costs, and reduced manufacturing costs for embodiments of the present invention as compared to the prior art.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. An apparatus comprising:

a first substrate having a first surface and a second surface, the first substrate comprising a first coil for generating a magnetic field, wherein the first coil is substantially planar and lies in a first plane, and wherein the first coil and the first substrate are monolithically integrated; and a second substrate comprising an electrical switch that comprises a first electrical contact and a second electrical contact, wherein the first electrical contact is moved by the magnetic field, and wherein the electrical switch and the second substrate are monolithically integrated, and further wherein the first electrical contact moves selectively in a second plane that is substantially parallel to the first plane;

wherein the first substrate further comprises a third electrical contact and a fourth electrical contact, and wherein the first coil is proximal to the first surface and distal to the second surface, and further wherein the third electrical contact and fourth electrical contact are proximal to the second surface and distal to the first surface; and wherein the first coil generates the magnetic field based on a first current that flows between the third electrical contact and the fourth electrical contact.

2. The apparatus of claim 1 wherein the first substrate further comprises a second coil for augmenting the magnetic field, wherein the second coil is substantially planar and lies in the first plane, and wherein the second coil and the first substrate are monolithically integrated.

3. The apparatus of claim 1 wherein the first substrate further comprises a second coil for augmenting the magnetic field, wherein the second coil is substantially planar and lies in a third plane that is substantially parallel to the first plane, and wherein the first coil and second coil are substantially concentric, and further wherein the second coil and the first substrate are monolithically integrated.

4. The apparatus of claim 1 wherein the first substrate further comprises:

a fifth electrical contact, wherein the first electrical contact and fifth electrical contact are electrically coupled; and a sixth electrical contact, wherein the second electrical contact and the sixth electrical contact are electrically coupled;

wherein the fifth electrical contact and sixth electrical contact are proximal to the second surface and distal to the first surface; and wherein the magnetic field moves the first electrical contact into physical contact with the second electrical contact and enables the flow of a second current between the fifth electrical contact and the sixth electrical contact.

5. The apparatus of claim 4 further comprising a closed magnetic circuit for channeling the magnetic field through the electrical switch, wherein the closed magnetic circuit comprises:

a first magnetic core, wherein the first magnetic core comprises the first electrical contact; and a second magnetic core, and wherein the second magnetic core comprises the second electrical contact.

6. An apparatus comprising:

a first coil for generating a magnetic field, wherein the first coil is substantially planar and lies in a first plane;

a first magnetic core for channeling the magnetic field, wherein the first magnetic core comprises a first electrical terminal and a first electrical contact that is movable, and wherein the first coil surrounds the first magnetic core in the first plane;

a second coil for augmenting the magnetic field, wherein the second coil is substantially planar and lies in a second plane; and a second magnetic core for channeling the magnetic field, wherein the second magnetic core comprises a second electrical terminal and a second electrical contact, and wherein the second coil surrounds the second magnetic core in the second plane;

wherein the first electrical contact and the second electrical contact collectively define a magnetically actuated switch for controlling the flow of a first current between the first electrical terminal and the second electrical terminal.

7. The apparatus of claim 6 wherein the first plane and the second plane are substantially the same plane.

8. The apparatus of claim 6 wherein the first coil and the second coil are electrically connected in series.

9. The apparatus of claim 6 wherein the first electrical contact is movable in a third plane that is substantially parallel to the first plane.

10. The apparatus of claim 6 further comprising a first substrate and a second substrate, wherein the first substrate, the first coil, and the second coil are monolithically integrated, and wherein the second substrate, the first electrical contact, and the second electrical contact are monolithically integrated.

11. An apparatus comprising:

(1) a first substrate that defines a first plane, wherein the first substrate comprises a plurality of coils for collectively generating a magnetic field, and wherein each of the coils is substantially planar and parallel to the first plane, and further wherein the first substrate and the plurality of coils are monolithically integrated;

(2) a second substrate comprising an electrical switch that comprises a first electrical contact and a second electrical contact, wherein the first electrical contact is dimensioned and arranged to move selectively in a second plane that is substantially parallel to the first plane, and further wherein the second substrate, the first electrical contact, and second electrical contact are monolithically integrated; and (3) a closed magnetic circuit for channeling the magnetic field through the electrical switch, wherein the closed magnetic circuit comprises;

(i) a first magnetic core comprising;

(a) a first via that is through the first substrate, wherein the first via and a first coil of the plurality of coils are concentric;

(b) a second via that is through the second substrate; and (c) a first anchor comprising a first member that is movable in the second plane, wherein the first member comprises the first electrical contact, and wherein the second substrate, the first anchor, and the first member are monolithically integrated;

wherein each of the first via, second via, and first anchor comprises ferromagnetic material; and (ii) a second magnetic core comprising;

(a) a third via that is through the first substrate, wherein the third via and a second coil of the plurality of coils are concentric;

(b) a fourth via that is through the second substrate; and (c) a second anchor comprising the second electrical contact, wherein the second substrate and the second anchor are monolithically integrated;

wherein each of the third via, fourth via, and second anchor comprises ferromagnetic material;

wherein the magnetic field moves the first electrical contact in the second plane to actuate the electrical switch.

12. The apparatus of claim 11 wherein the first substrate further comprises:

(3) a third electrical contact;

(4) a fourth electrical contact, wherein the third electrical contact, each of the plurality of coils, and the fourth electrical contact are electrically coupled;

(5) a fifth electrical contact, wherein the fifth electrical contact and the first electrical contact are electrically coupled; and (6) a sixth electrical contact, wherein the sixth electrical contact and the second electrical contact are electrically coupled;

wherein the first substrate comprises a first surface and a second surface, and wherein each of the plurality of coils is proximal to the first surface and distal to the second surface;

wherein the third electrical contact, fourth electrical contact, fifth electrical contact, and sixth electrical contact are proximal to the second surface and distal to the first surface; and wherein the magnetic field electrically couples the first electrical contact and second electrical contact and enables the flow of a current between the fifth electrical contact and the sixth electrical contact.

13. A method comprising:

(1) providing a first substrate comprising a first coil for generating a magnetic field, wherein the first coil is substantially planar and lies in a first plane;

(2) providing a second substrate comprising an electrical switch that is a magnetically actuated switch, wherein the electrical switch comprises a first electrical contact and a second electrical contact, and wherein the first electrical contact is movable selectively in a second plane;

(3) arranging the first substrate and second substrate in a first arrangement wherein the second plane is substantially parallel to the first plane; and (4) enabling the coupling of the magnetic field and electrical switch by operations comprising;

(i) providing a first magnetic core, wherein the first coil surrounds the first magnetic core in the first plane, and wherein the first magnetic core is provided by operations comprising;

(a) forming a first via through the first substrate;

(b) forming a second via through the second substrate; and (c) forming a first anchor on the second substrate, wherein the first anchor comprises a first member that is movable in the second plane, and wherein the first member comprises the first electrical contact;

wherein each of the first via, second via, and first anchor comprises ferromagnetic material; and (ii) providing a second magnetic core, wherein the first magnetic core and second magnetic core collectively define a closed magnetic circuit, and wherein the second magnetic core is provided by operations comprising;

(a) forming a third via that is through the first substrate;

(b) forming a fourth via that is through the second substrate; and (c) forming a second anchor on the second substrate, wherein the second anchor comprises the second electrical contact;

wherein each of the third via, fourth via, and second anchor comprises ferromagnetic material;

wherein the first magnetic core and second magnetic core are dimensioned and arranged to collectively channel the magnetic field through the electrical switch, and wherein the first arrangement enables magnetic coupling between the first and second via and between the third and fourth via.

14. The method of claim 13 further comprising:

providing a third electrical contact;

providing a fourth electrical contact, wherein the third electrical contact, first coil, and fourth electrical contact are electrically coupled;

providing a fifth electrical contact that is electrically coupled with the first electrical contact; and providing a sixth electrical contact that is electrically coupled with the second electrical contact;

wherein the first substrate comprises the third electrical contact, fourth electrical contact, fifth electrical contact, and sixth electrical contact, and wherein the first substrate comprises a first surface and a second surface, and wherein the first coil is proximal to the first surface and distal to the second surface, and further wherein each of the third electrical contact, fourth electrical contact, fifth electrical contact, and sixth electrical contact is proximal to the second surface and distal to the first surface.

15. The method of claim 13 further comprising providing a second coil for augmenting the magnetic field, wherein the first substrate comprises the second coil, and wherein the second coil is substantially planar and lies in the first plane.

16. The method of claim 13 further comprising providing a second coil for augmenting the magnetic field, wherein the first substrate comprises the second coil, and wherein the second coil is substantially planar and lies in a third plane that is substantially parallel to the first plane, and further wherein the first coil and second coil are substantially concentric.

* * * * *